US005904383A

United States Patent [19]

van der Wal

[11] Patent Number: 5,904,383

[45] Date of Patent: May 18, 1999

[54] ANTI-THEFT BOLT GUARD

[76] Inventor: Johannes van der Wal, 541 Wrentham Rd., Bellingham, Mass. 02019

[21] Appl. No.: 08/881,546

[22] Filed: Jun. 24, 1997

[51] Int. Cl.[6] ..... B65D 27/30

[52] U.S. Cl. ..... 292/307 B; 411/373; 70/229

[58] Field of Search ..... 292/307 B, 307 R, 292/327; 70/58, 229–232; 411/371–374, 369, 429, 542, 10, 910, 431, 430, 377

[56] References Cited

U.S. PATENT DOCUMENTS

| | | | |
|---|---|---|---|
| 2,345,949 | 4/1944 | Robbins | 70/232 |
| 3,492,841 | 2/1970 | Ipri | 411/429 |
| 4,203,382 | 5/1980 | Mullen | 292/307 B |
| 4,302,137 | 11/1981 | Hart | 411/432 |
| 4,325,701 | 4/1982 | Peters et al. | 440/113 |
| 4,374,509 | 2/1983 | Kawabata | 292/307 B |
| 4,502,306 | 3/1985 | Scammacca | 70/159 |
| 4,521,146 | 6/1985 | Wharton | 411/910 |
| 4,557,458 | 12/1985 | Vahlberg et al. | 248/553 |
| 4,602,903 | 7/1986 | Wilburn | 411/432 |
| 4,611,379 | 9/1986 | Heitzman | 411/910 |
| 4,621,230 | 11/1986 | Crouch et al. | 324/110 |
| 4,710,082 | 12/1987 | Curtis | 411/373 |
| 4,726,723 | 2/1988 | Bainbridge | 411/910 |
| 4,732,517 | 3/1988 | Crouch et al. | 411/39 |
| 4,742,702 | 5/1988 | Swertz | 411/910 |
| 4,826,380 | 5/1989 | Henry | 411/910 |
| 4,883,399 | 11/1989 | MacLean | 411/431 |
| 5,131,796 | 7/1992 | Herum | 411/910 |
| 5,167,395 | 12/1992 | Pearman et al. | 248/551 |
| 5,280,941 | 1/1994 | Guhlin | 280/507 |
| 5,360,304 | 11/1994 | Notaro et al. | 411/432 |
| 5,533,852 | 7/1996 | Matthews | 411/534 |

*Primary Examiner*—Steven Meyers
*Assistant Examiner*—Gary Estremsky
*Attorney, Agent, or Firm*—Ronald R. Kilponen

[57] ABSTRACT

An anti-theft bolt guard is shown having a cylindrical body (65) for placing over a nut (60) of an installed bolt (30). Third washer (45) engages bolt (30) and the body (65) is affixed to the bolt (30) with a threaded circular guard nut (85). The guard nut (85) is tightened with a special key (120). A fourth washer (46) engages the guard nut (85) and an adhesive (57) material may be inserted. The guard nut (85) is then sealed off with the insertion of a press fit seal cover (95) thus providing a device that prevents easy access to the nut (60) and removal of the bolt (30).

Protection for the exposed head (32) of a bolt can be obtained by inserting the bolt (30) through a head guard (35) where a press fit head cover (25) is inserted in the first end (36). An adhesive (57) can be inserted to increase the difficulty of removal of the protection device.

7 Claims, 8 Drawing Sheets

ANTI-THEFT BOLT GUARD

FIELD

The present version of this invention relates generally to the field of devices for securing bolts. This device will be especially useful for securing out drives, motors and drive components to marine vessels to prevent theft of these components.

BACKGROUND

Boating has become a tremendously popular sport and more and more individuals have purchased larger and more expensive marine vessels. These expensive vessels have a motor and transmission engaging an out drive, which extends from the rear of the boat, to which the propeller is affixed which in turn drives the boat. The out drive is generally bolted to the transmission through the rear of the vessel. This allows for removal of the out drives for service or maintenance and a relative ease of removal for theft. When vessels are in storage, it is quite easy to steal the out drive by removing the attachment bolts with common tools. Thefts of out drives while the vessels have been docked have also occurred. Thefts of components can be extremely costly, in the tens of thousands of dollars.

In addition, thieves have removed motors and other drive components, with common tools, from vessels that can relatively easily be resold in this country or foreign countries. Other prior art devices do exist, but these are of poor quality materials and can be and have been defeated rather easily resulting in equipment losses. Prior art devices also corrode and can fail from corrosion.

Consequently, there is a need for a device that will exponentially increase the difficulty of unauthorized removal of components from a vessel. Ideally, this device will be relatively inexpensive, relatively easy to manufacture, not affected by salt or fresh water exposure yet allow authorized service and maintenance personnel to service the components with the proper tools.

For the foregoing reasons, there is a need for an Anti-theft Bolt Guard.

SUMMARY

In view of the foregoing disadvantages inherent in the prior art or that occur from no protection, there are shown several embodiments of an Anti-theft Bolt Guard.

A first object of the invention is to provide a device that can be relatively cheaply manufactured.

Another object of the invention is to provide a device that will be difficult to remove without the proper tools.

It is yet another object of the invention to design a device that will not corrode substantially from the working environment causing potential failure and ultimately increased ease of theft.

It is a still further object of the invention to prevent theft of objects that are bolted to other objects and provide a device that is not easily defeated.

To accomplish the above and other beneficial items, the present invention is in the form of a cylindrical body piece that fits over the previously installed bolt, washer and nut. This body is a tube of very durable material which is generally unaffected by the environment. The body has a number of different diameter sections concentrically located around the longitudinal axis.

Once the body is installed over the washer, bolt and nut, a washer and a guard nut are inserted into the body and threaded to the bolt threads with a special keyed device and tightened against a ring surface in the body. The guard nut is circular and disk shaped preventing the gripping of the nut with conventional tools. Because the nut is contained within the body, it is very difficult to remove the nut with a conventional tool. The keyed device can be of a proprietary design so that even if access to the nut is obtained, an unauthorized person would have a difficult time engaging the guard nut. The guard nut does not easily lend itself to removal with commonly available tools.

Once the guard nut is installed and secured, a second washer is inserted and a water proof adhesive can be squeezed into the body. The body is sealed off with a seal cover which is press fit into the body, thereby creating a water tight seal and preventing access to the guard nut. The seal cover is inserted into the body to sit flush, thereby preventing removal of the cover without access to more sophisticated tools.

This thus prevents the removal of the guard nut, the secured bolt, and unauthorized removal of the vessel components. While no device can completely prevent removal of components if a thief wishes to steal them, this device will slow the thieves down significantly. It is envisioned they will move on to easier prey or vessels not incorporating securing devices such as these disclosed and claimed in this embodiment.

While this device is shown and described primarily for the protection of components for water vessels, it is to be understood that this device could be used to secure any object which is affixed with a bolt and nut.

These together with other objects of this invention, along with various features of novelty which characterize this invention, are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment of this version of the invention.

DETAILED DESCRIPTION OF THE PREFERRED EMBODIMENTS

Figure 1:
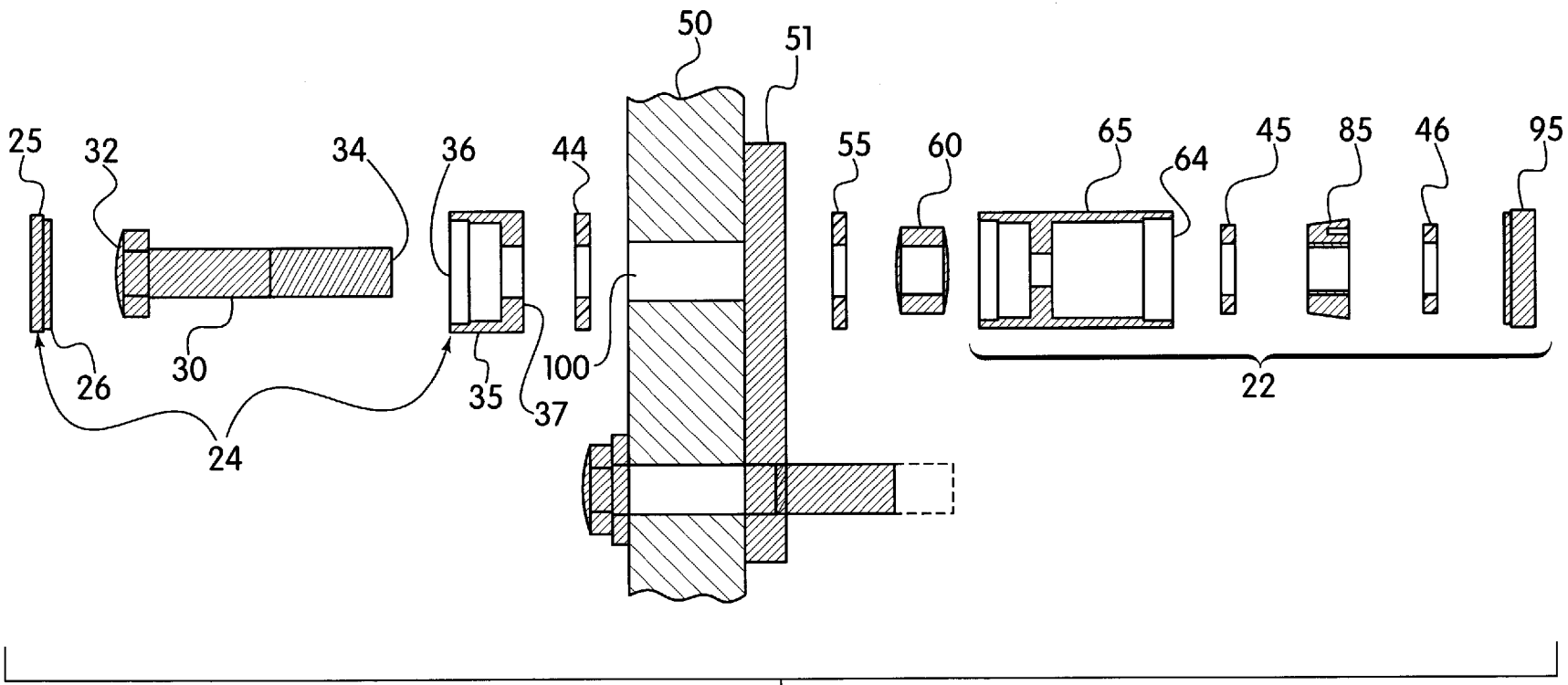
FIG. 1 shows an exploded cross sectional view of one embodiment of the present invention with the head device and bolt guard.

Referring to the drawings in detail wherein like elements are indicated by like numerals, there is shown in FIG. 1 an exploded view of one embodiment of the present invention and existing components to which it would be applied.

A bolt 30 can be inserted through a surface 50 having a hole 100. The bolt 30 can be of any size. Generally a first washer 44 is adjacent to the head 32 and is retained between the head 32 and the surface 50, when the threaded end 34 is inserted through the hole 100 second. A washer 55 is then slipped over the threaded end 34 and secured by a nut 60. This configuration represents what generally exists on devices in which no additional security is utilized.

Figure 4:
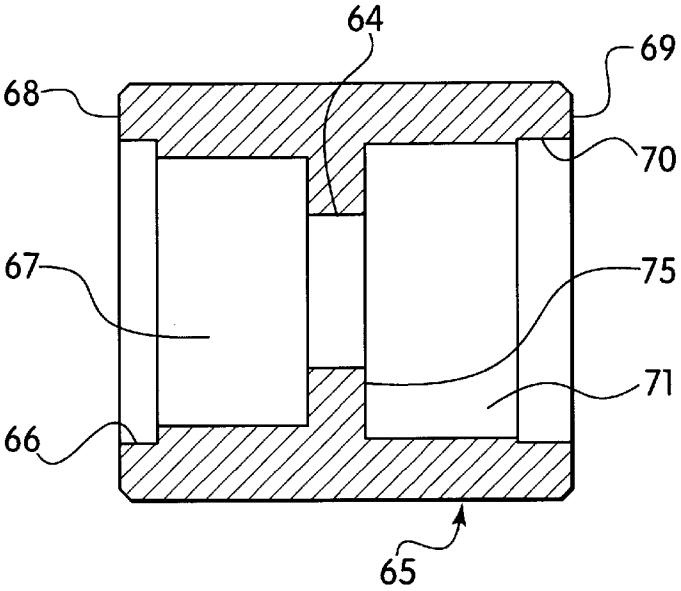
FIG. 4 shows a cross section along line A—A of FIG. 5 of one embodiment of the body.
Figure 5:
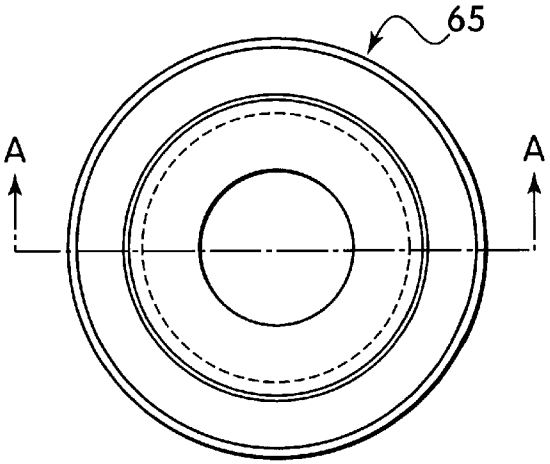
FIG. 5 shows an end view of the body component of one embodiment.

One embodiment of this invention utilizes a body 65, FIG. 4. The body 65, is a cylindrical piece of material with a hole 64 for insertion over the bolt 30, washer 55 and nut 60. The hole 64 is of a diameter large enough to allow passage of the threaded end 34 but not so large that the body 65 can be moved radially back and forth against the bolt 30. In a preferred embodiment, the body is machined from 316 Stainless steel, although other materials both ferrous and non-ferrous may be used.

Body 65 has a first end 68 and a second end 69, FIG. 4. The first end 68 is inserted on the threaded end 34 of bolt 30 such that an appropriately sized washer ledge 66 circumscribes washer 55, FIGS. 2 & 4, and first end 68 rests against plate 51, FIG. 2. In this position, nut 60 is located in the nut recess 67 with a gap 28 between the nut 60 and ring surface 75, while the threaded end 34 extends through the hole 64 to the lock recess 71 near the second end 69 of the body 65.

An adhesive such as those commonly know in the art can be installed between the washer 55 and the body 65 to encourage a water tight seal between these two components.

Figure 6:
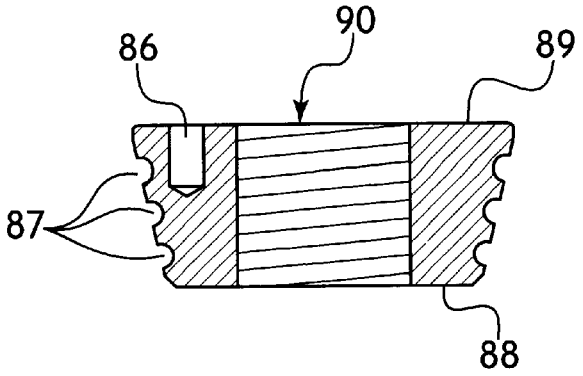
FIG. 6 shows a cross section along line B—B of FIG. 7 of one embodiment of the guard nut.
Figure 7:
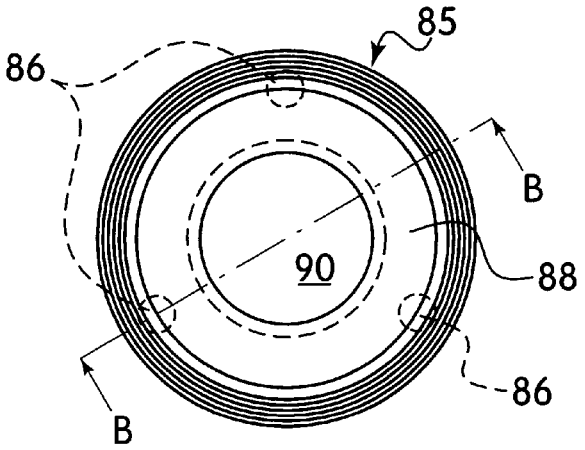
FIG. 7 shows an end view of one embodiment of the guard nut.

Once the body 65 is installed over the washer 55, nut 60 and threaded end 34 of the bolt 30, third washer 45 is inserted and the guard nut 85 is threaded on threaded end 34 and tightened with the key 120. This biases guard nut 85 against the third washer 45 which then contacts the ring surface 75, FIGS. 2, 4 & 15. FIGS. 6 & 7 show the guard nut 85 which is circular in cross section and disk shaped. The cross section tapers from the second end 89 becoming more narrow at a first end 88. Around the circumference between the second end 89 and the first end 88 can be located identification grooves 87. Because the guard nut 85 can be used on many different size threads, the grooves 87 can be used to identify the thread size for packaging and other purposes. The guard nut 85, in a preferred embodiment is made from 316 stainless steel, although, other materials both ferrous and non-ferrous may be used.

An adhesive, as is commonly known in the art, can be applied to the threads of the bolt 30 to secure the guard nut 85 to the bolt 30. Third and fourth washers 45, 45' and 46, 46' are made from nylon in a preferred embodiment, but other materials could be utilized. A key 120, or special tool, is used to tighten the guard nut 85 on the bolt 30.

Figure 15:
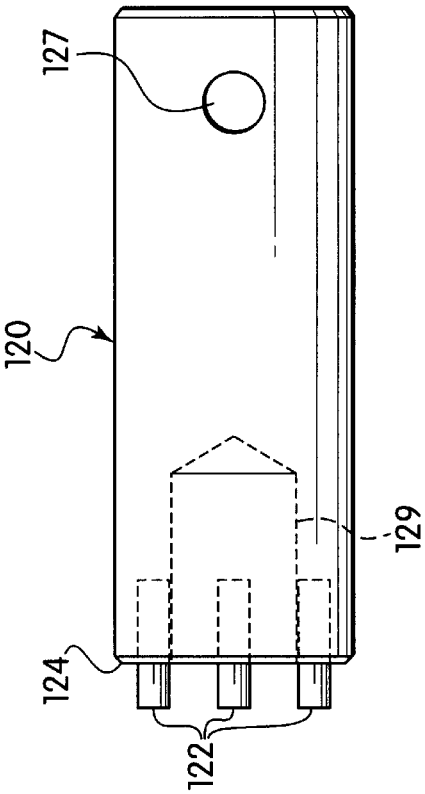
FIG. 15 shows a side view of one embodiment of the key.
Figure 17B:
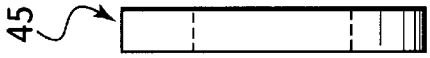
FIG. 17A shows an end view of the washer and 17B shows a side view of the washer.
Figure 17A:
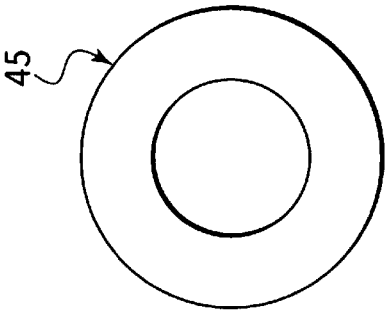
Figure 14:
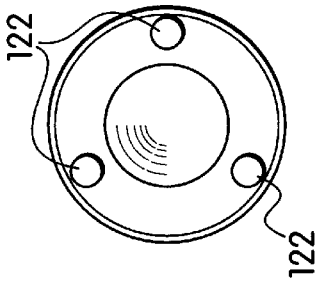
FIG. 14 shows an end of the key end view of one embodiment of the key.

Key 120, FIG. 15, has a series of pins 122, on the key end 124, this embodiment shows three at an angle of approximately 120° on a common circumference. It is to be understood that the number, location, length and diameter of the pins 122 relative to one another and the corresponding key end 124, could both be modified and still be within the scope of this invention. Obviously the location and size of the pins 122 would correspond to the size and location of the pin holes 86 in the second end 89 of the guard nut 85.

The key 120 is turned on the tool end 125 with a rod or screwdriver (not shown) inserted in the driver hole 127.

The key 120 has a bolt void 129 in the key end 124 for tightening guard nuts 85 on bolts 30 with long threaded ends 34. After the guard nut 85 is tightened to an appropriate design torque, a fourth washer 46 is installed on threaded end 34 to rest flush against guard nut 85, FIG. 2.

Figure 2:
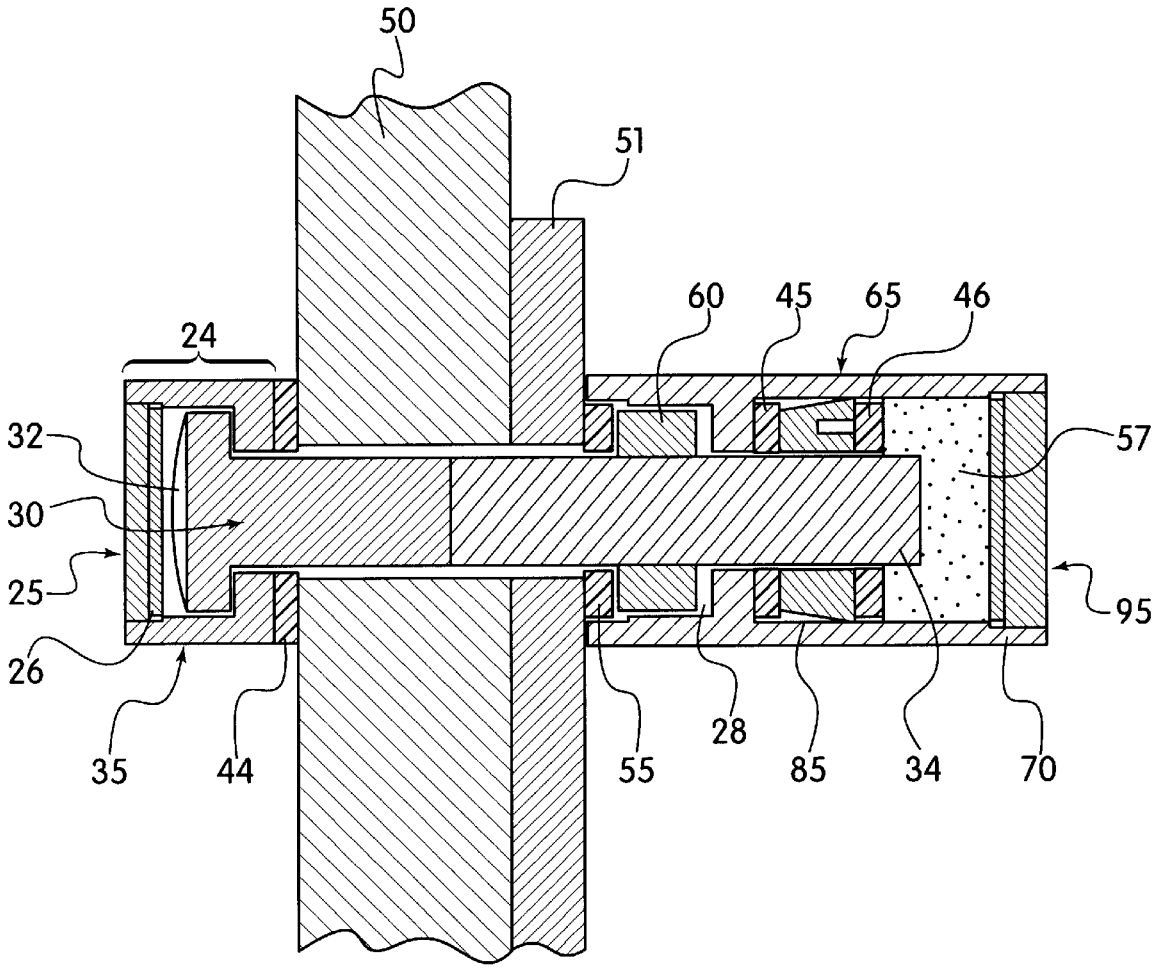
FIG. 2 shows an assembled cross section view of one embodiment of the present invention with the head device and bolt guard as shown in FIG. 1.
Figure 3:
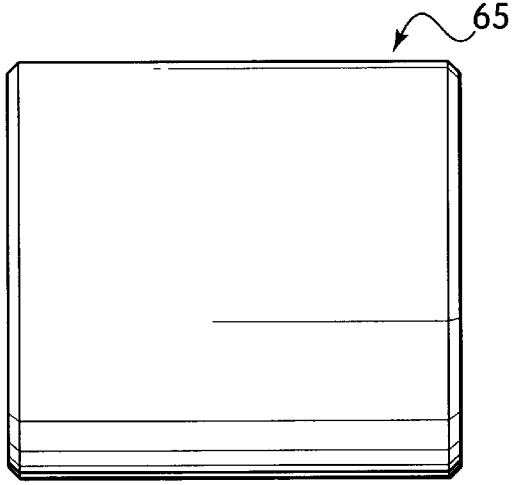
FIG. 3 shows a side view of the body component of one embodiment.

Once the guard nut 85 and fourth washer 46 are installed, a viscous water resistent adhesive 57 can be inserted on the fourth washer 46 effectively filling the lock recess 71, FIG. 2. This too can help prevent the removal of the guard nut 85. The fourth washer 46 prevents the adhesive 57 from filling pin holes 86 on the guard nut 85. If one wished to increase the difficulty of removing the guard nut 85, fourth washer 46 could be excluded thereby allowing the adhesive to fill pin holes 86.

Figure 8:
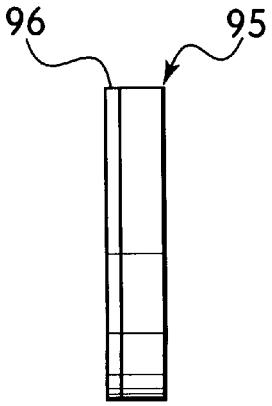
FIG. 8 shows a side view of one embodiment of the seal cover.
Figure 9:
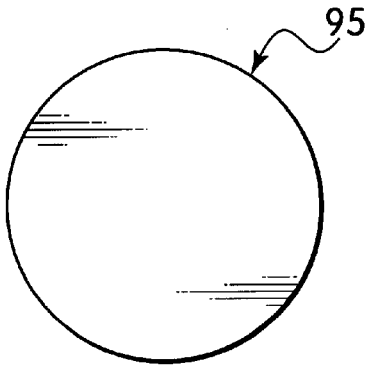
FIG. 9 shows a top view of one embodiment of the seal cover.
Figure 11:
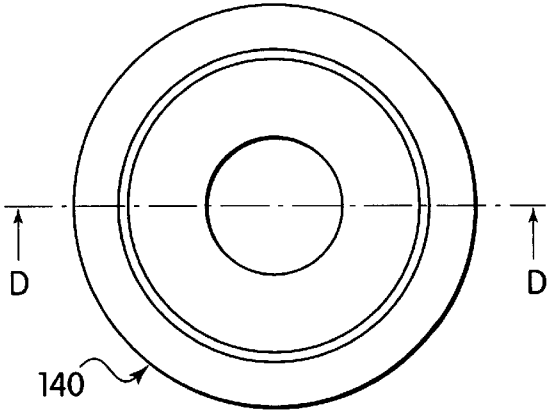
FIG. 11 shows an end view of the body.
Figure 13:
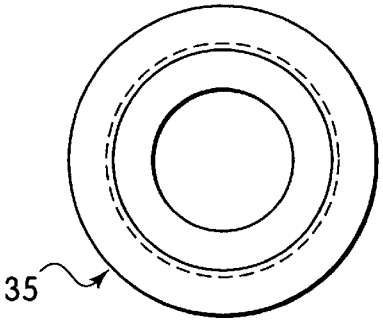
FIG. 13 shows an end view of one embodiment of the head guard.
Figure 10:
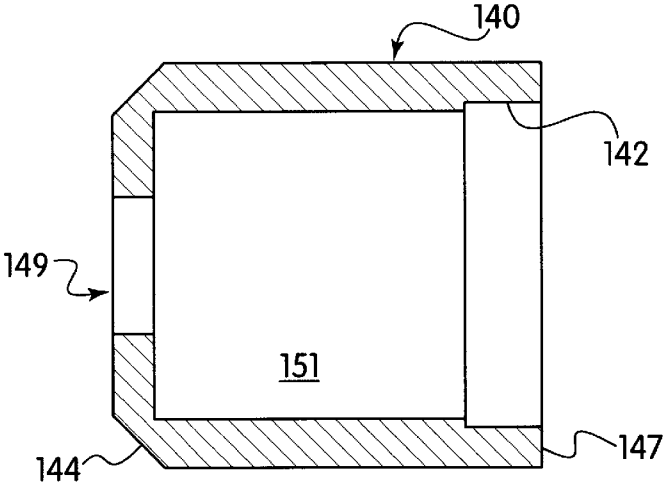
FIG. 10 shows a cross section along D—D in FIG. 11 of the body.

A seal cover 95 is then press fit into the cover ledge 70 of the body 65. The seal cover 95, FIG. 8 & 9, has a recess 96 appropriately sized to be press fit into the body 65 cover ledge 70 where the seal cover 95 is installed flush with the body 65. The recess 96 is designed to facilitate the insertion of the seal cover 95 flush with the second edge 69, best shown in FIG. 2. This sealing provides an essentially waterproof seal while discouraging unauthorized access to the guard nut 85 and ultimate removal of the nut 60 and/or bolt 30.

The bolt guard 22 is now in place. A thief or vandal would have a difficult time in removing the bolt 30 to steal components. The thief has no access to the nut 60 for unscrewing, nor to the bolt 30 for cutting. The body 65 is secured right up against the plate 51 to prevent access to the original bolt 30 or nut 60. A thief cannot gain access to the guard nut 85 without removal of the seal cover 95. Since this is press fit into the body 65, a thief would have to drill a hole in the seal cover 95 and insert a tool in the drilled hole and pull the seal cover 95 off.

Assuming a thief wanted to remove the anti-theft bolt guard 22, they would need to drill a hole in a very hard material with hand tools or possibly a battery operated device which is very time consuming. Assuming the seal cover 95 is removed, the bolt guard 22 is far from defeated.

Once the seal cover 95 is removed, if the installer utilized the water resistant adhesive, the thief must remove this from the lock recess 71 to gain access for removal of fourth washer 46 and guard nut 85. Alternatively, if the fourth washer 46 was not used, the thief must remove the water resistant adhesive from the lock recess 71 in addition to the pin holes 86 and insert the appropriate key 120 to remove the guard nut 85. This presumes that the thief would have the appropriate configured key 120. If they do not have the proper key 120, the guard nut 85 is very difficult to remove because of it's round shape and the minimal clearance between the guard nut 85 and the lock recess 71.

Provided the thief was able to remove the guard nut 85, this would finally allow the removal of the body 65 from the bolt 30 and nut 60. The nut 60 could then be removed and the component unbolted, and removed.

The steps required to remove the bolt guard 22 are very time consuming and would strongly discourage a thief from removing it and stealing the attached parts.

The above description provides protection for a nut and bolt when only the nut 60 is exposed. If the installation is such that the head 32 of the bolt 30 is exposed a similar procedure can be used to install a head device 24, FIG. 1.

To supplement the protection of a bolt 30 in which the head 32 is also exposed in addition to the nut 60, a head device 24 including a head guard 35 and head cover 25 having a recess 26 could be installed.

Figure 12:
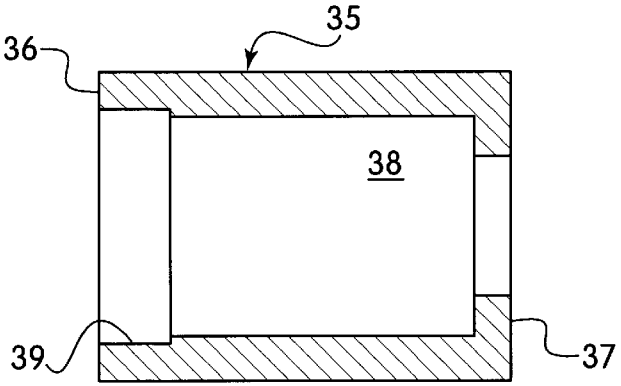
FIG. 12 shows a section view along C—C of FIG. 13 of the head guard.
Figure 16:
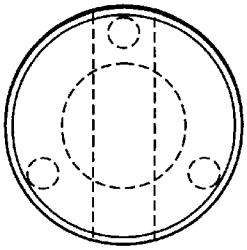
FIG. 16 shows an end view of the key.

In this instance the bolt 30 would have to be removed from surface 50 and plate 51. The head guard 35 is slipped over the threaded end 34 of bolt 30 and located against head 32. Next the bolt 30 is installed and nut 60 tightened. Head cover 25 is then press fit into first end 36. This seals off the head 32 and prevents easy access to the head 32 and subsequent removal of the bolt 30. Water resistant adhesive (not shown) could also be utilized in this installation between the head guard 35 and surface 50 to discourage water from penetrating the head guard 35. Water resistant adhesive (not shown) could also be utilized in the head recess 38, FIG. 12, before press fitting the head cover 25 flush with first end 36.

Depending on the configuration and exposure of the bolt 30, and the users preference, the user could install either a bolt guard 22, only, or, bolt guard 22 and head device 24, FIG. 1.

Figure 18:
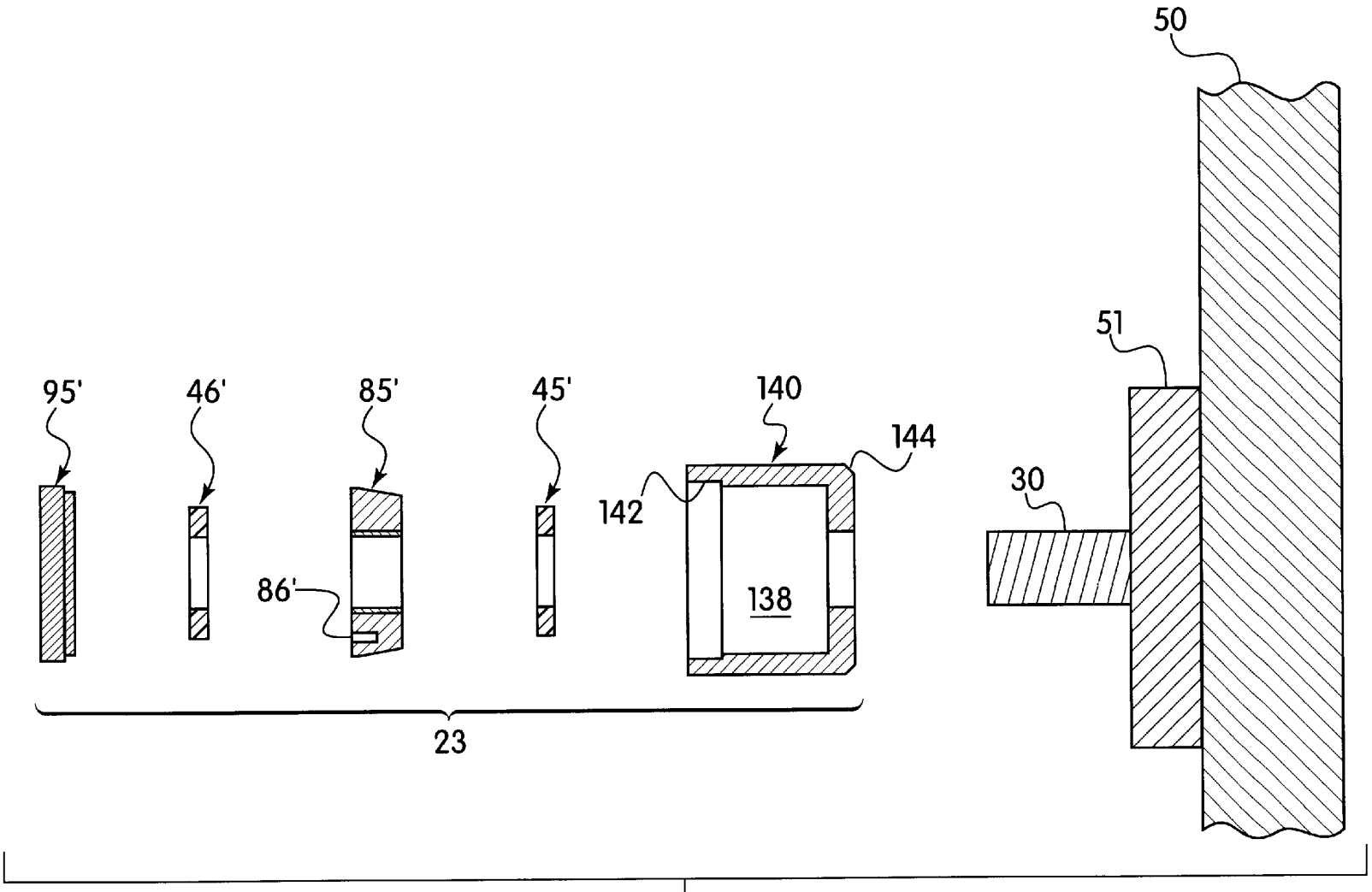
FIG. 18 shows an exploded cross section view of an alternative embodiment of the bolt guard for attachment to a bolt without an additional or existing nut.
Figure 19:
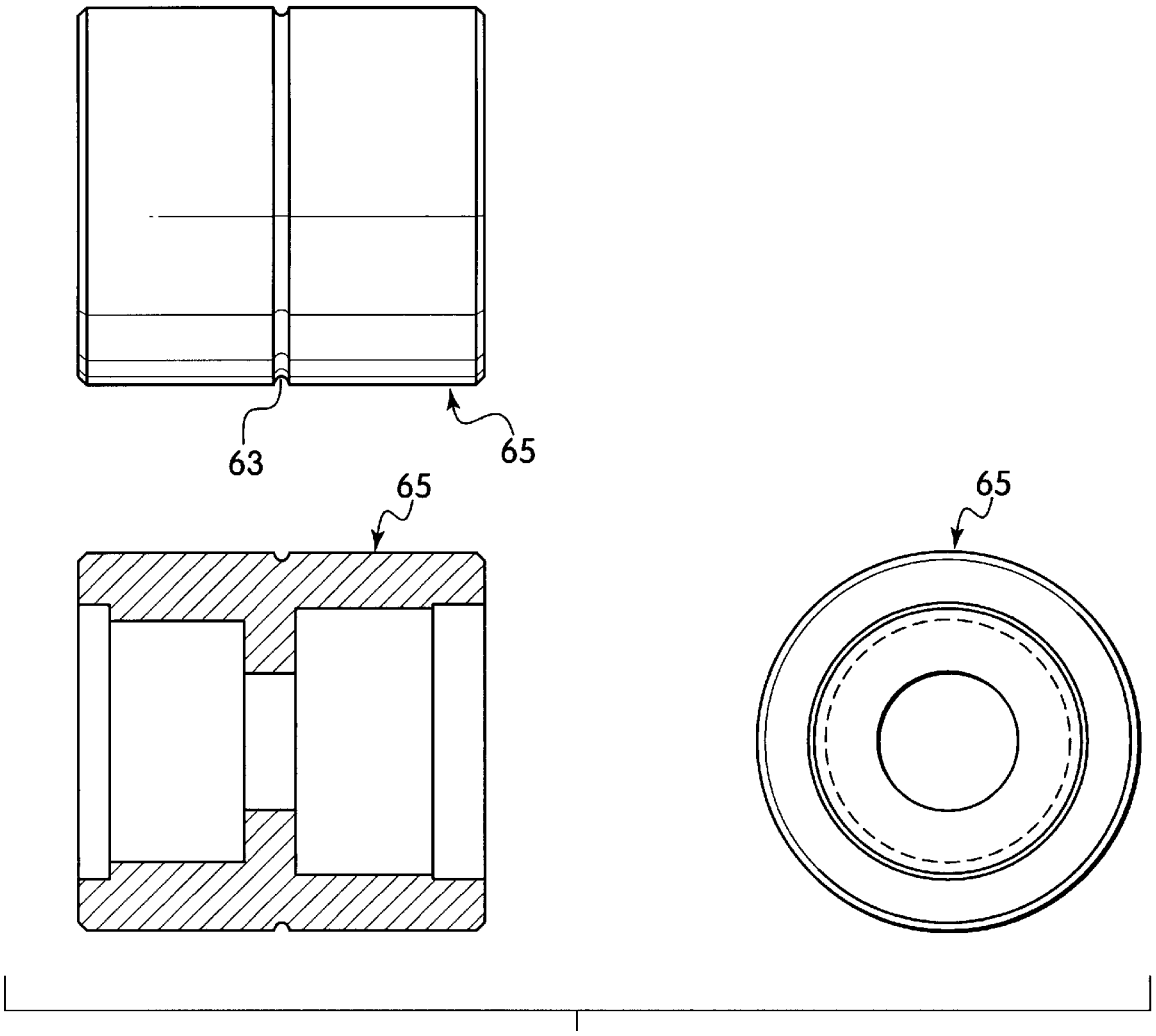
FIG. 19 shows another embodiment of the body with an indicator trough.

FIG. 18 shows an exploded view of an alternative embodiment of a bolt guard 23. The body 140 is preferably machined from 316 stainless steel, but other ferrous and non-ferrous materials could be used.

In this embodiment, the bolt 30 is too short to accommodate both a regular nut and the guard nut 85'. In this embodiment, the body 140 is installed over the bolt 30 followed by washer 45' and guard nut 85'. Guard nut 85' also has pin holes 86' for engagement of a tool such as key 120. Key 120 tightens the guard nut 85' to an appropriate design torque and fourth washer 46' is installed followed by, if the user desires, adhesive 57' (not shown). The third and fourth washers 45' and 46' are in a preferred embodiment made from nylon, but other materials could be utilized. The body 140 is sealed flush with press fit seal cover 95'.

The seal cover 95' is preferably machined from 316 stainless steel, but other ferrous and non-ferrous materials could be used. This configuration likewise provides enhanced protection to the bolt and deters all thieves but the very persistent, having both extensive tools and time. This alternative embodiment of the bolt guard 23 could also be installed in combination with the head device 24, FIG. 1, or by itself.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

I claim:

1. An anti-theft bolt guard for engaging and securing a nut on a threaded end of a bolt, the guard comprising:

a cylindrical body having a concentric hole through a longitudinal axis and a first end and a second end, said second end having a cover ledge, a corresponding seal cover for engagement within the cover ledge, said first end for circumscribing the threaded end of the bolt and nut with a gap interposed between the nut and a ring surface, a lock recess having a larger diameter than the hole located near said second end, a disk shaped guard nut housed within the lock recess;

said guard nut having a centrally located threaded hole therethrough corresponding in size for engagement with the bolt, said guard nut having a smaller diameter first end which tapers to a larger diameter second end wherein at least one pin hole opens from said second end, said guard nut contained within the lock recess in an installed position; and a third washer for placement on the bolt, said third washer located between the first end of the guard nut and the ring surface;

a fourth washer for placement on the bolt, said fourth washer adjacent to the second end of the guard nut;

said seal cover having a recess diameter corresponding in size to the cover ledge of the body such that said seal cover is press fit and secured flush within the second end of the body.

2. The anti theft bolt guard of claim 1 further comprising:

a viscous adhesive material inserted in the lock recess whereby the adhesive prevents access to the guard nut and discourages water penetration into the bolt guard.

3. An anti-theft device for securing a bolt having a head a first washer, a threaded end, a second washer and a nut, the anti-theft device comprising:

a cylindrical body having a concentric hole through a longitudinal axis and a first and second end, said second end having a cover ledge, a corresponding seal cover for engagement within the cover ledge, said first end having a washer ledge with diameter larger than the hole for circumscribing the second washer, a nut recess located near said first end for circumscribing the nut with a gap interposed between the nut and a ring surface, said body first end for engaging the second washer, nut and threaded end of the bolt, a lock recess located near the second end, a disk shaped guard nut located within the lock recess for engaging the threaded end of the bolt;

said guard nut having a centrally located threaded hole corresponding in size for engagement with the threaded end of the bolt, said guard nut having a smaller diameter first end which tapers to a larger diameter second end wherein at least one pin hole opens from said second end, said guard nut contained within the lock recess in an installed position;

a third washer for placement on the bolt, said third washer located between the first end of the guard nut and the ring surface, a fourth washer for placement on the bolt, said fourth washer adjacent to the second end of the guard nut;

said seal cover having a recess diameter corresponding to the cover ledge of the body such that said seal cover is press fit and secured flush within the second end of the body;

a head guard having a cylindrical shape and a concentric hole through a longitudinal axis, said hole sized for allowing passage therethrough of the threaded end but not the head, said head guard having a first end and a second end with a concentric cylindrical head recess located between the first end and the second end, a cover ledge located near the first end, a head cover for engagement within the cover ledge; and said head guard for engagement with the head such that the head is contained within the head recess in the installed position, said head cover having a recess corresponding in size to the cover ledge such that said head cover can be press fit flush within the first end of the head guard.

4. The anti theft device of claim 3 further comprising:

a viscous adhesive material inserted in the lock recess whereby the adhesive prevents access to the guard nut and discourages water penetration into the bolt guard.

5. An anti-theft bolt guard for engaging and securing the threaded end of a bolt and nut, the bolt guard comprising:

a cylindrical body having a first end and a second end with a longitudinal axis and a concentric hole extending from the first end to the second end, a concentric cover ledge near the second end and a concentric lock recess between the cover ledge and the first end, a concentric washer ledge near the first end and a concentric nut recess between the washer ledge and second end;

the washer ledge for circumscribing a second washer, the cylindrical body for installation over the threaded end and nut with a gap interposed between the nut and a ring surface where the first end of the body is flush against a plate and the threaded end of the bolt is disposed within the concentric hole;

a circular disk shaped guard nut having a first end and a second end and a concentric threaded hole therethrough, the second end having at least one pin hole, for engagement with a key, where the guard nut is located within the lock recess when threaded to the bolt;

a third washer located between the first end of the guard nut and the ring surface, a fourth washer located adjacent the second end of the guard nut; and a circular seal cover having a recess for installation in the cover ledge such that the seal cover is installed flush with the second end of the body.

6. The anti-theft bolt guard of claim 5 further comprising:

a water resistant viscous adhesive inserted in the lock recess whereby the adhesive prevents access to the guard nut and discourages water penetration into the bolt guard.

7. The anti-theft bolt guard of claim 5 further comprising:

a water resistant adhesive within the first end whereby the adhesive discourages water penetration into the bolt guard.

* * * * *